US011306729B2

(12) United States Patent
Wang et al.

(10) Patent No.: US 11,306,729 B2
(45) Date of Patent: Apr. 19, 2022

(54) AXIAL FLOW IMPELLER AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Bo Wang, Foshan (CN); Xujie Cai, Foshan (CN); Hejie Zhou, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 6 days.

(21) Appl. No.: 16/918,168

(22) Filed: Jul. 1, 2020

(65) Prior Publication Data

US 2020/0332807 A1 Oct. 22, 2020

Related U.S. Application Data

(63) Continuation of application No. PCT/CN2018/084877, filed on Apr. 27, 2018.

(30) Foreign Application Priority Data

Feb. 7, 2018 (CN) ..... 201810138859.7

(51) Int. Cl.
*F04D 29/38* (2006.01)
*F04D 19/00* (2006.01)
(Continued)

(52) U.S. Cl.
CPC ..... *F04D 29/384* (2013.01); *F04D 19/002* (2013.01); *F04D 29/325* (2013.01);
(Continued)

(58) Field of Classification Search
CPC .... F04D 29/384; F04D 29/386; F04D 19/002; F24F 1/38; F05B 2240/301; F05B 2260/232
See application file for complete search history.

(56) References Cited

U.S. PATENT DOCUMENTS 6,113,353 A * 9/2000 Sato ..... F04D 29/384 415/119
2003/0007872 A1* 1/2003 Bradbury ..... F04D 29/384 416/223 R
(Continued)

FOREIGN PATENT DOCUMENTS

CN 204344525 U 5/2015
CN 104791301 A 7/2015
(Continued)

OTHER PUBLICATIONS

Japan Patent Office (JPO) The Office Action For JP Application No. 2020-529190 dated May 25, 2021 12 Pages (Translation Included).
(Continued)

*Primary Examiner* — Christopher Verdier
*Assistant Examiner* — Michael K. Reitz
(74) *Attorney, Agent, or Firm* — Anova Law Group PLLC

(57) ABSTRACT

An axial flow impeller includes a hub and a blade at the hub. A blade edge of the blade includes a blade root edge, a front blade edge, a blade top edge, and a rear blade edge connected sequentially. The blade includes a divider strip arranged between the front blade edge and the rear blade edge and connecting the blade root edge and the blade top edge. At a same circumference, a ratio between a circumferential span from the divider to the front blade edge and a circumferential span from the front blade edge to the rear blade edge is equal to or greater than 0.2 and equal to or smaller than 0.4, a thickness of the divider strip is greater
(Continued)

than thicknesses of other portions of the blade, and a thickness of the rear blade edge is smaller than a thickness of the front blade edge.

18 Claims, 7 Drawing Sheets

(51) Int. Cl.
*F04D 29/32* (2006.01)
*F24F 1/38* (2011.01)

(52) U.S. Cl.
CPC ..... *F24F 1/38* (2013.01); *F05B 2240/301* (2013.01); *F05B 2260/232* (2013.01)

(56) References Cited

U.S. PATENT DOCUMENTS

2005/0232778 A1* 10/2005 Kakishita ..... F01D 5/141
416/223 R
2008/0044292 A1* 2/2008 Spaggiari ..... F04D 29/329
416/243
2014/0271172 A1* 9/2014 Van Houten ..... F04D 29/681
415/211.1

FOREIGN PATENT DOCUMENTS

| | | | |
|---|---|---|---|
| CN | 106337840 | A | 1/2017 |
| CN | 106438470 | A | 2/2017 |
| JP | 11132194 | A | 5/1999 |
| JP | 2002021787 | A | 1/2002 |
| JP | 2002507699 | A | 3/2002 |
| WO | 02075159 | A1 | 9/2002 |

OTHER PUBLICATIONS

World Intellectual Property Organization (WIPO) International Search Report and Written Opinion for PCT/CN2018/084877 dated Oct. 15, 2018 14 Pages.

* cited by examiner

AXIAL FLOW IMPELLER AND AIR CONDITIONER

CROSS-REFERENCE TO RELATED APPLICATIONS

This application is a continuation of International Application No. PCT/CN2018/084877, filed on Apr. 27, 2018, which claims priority to Chinese Application No. 201810138859.7, filed on Feb. 7, 2018, which is hereby incorporated by reference in its entirety.

TECHNICAL FIELD

The present disclosure relates to the technical field of air conditioners, in particular to an axial flow impeller and an air conditioner.

BACKGROUND

An axial flow impeller is commonly used in a household appliance or an air conditioner to serve as a ventilation device. When rotating, the axial flow impeller drives the air in its circumferential direction to rotate, forming an airflow, and drives the air flow to blow out along the axial direction of the axial flow impeller. Thicknesses of the blade of the conventional axial flow impeller at various positions of the same circumference are basically equal. When the airflow flows from a front blade edge to a rear blade edge of the blade, the airflow separates before reaching the rear blade edge. As a result, the airflow becomes turbulent at a position adjacent to the rear blade edge of the blade, which generates a large turbulent noise.

SUMMARY

The main objective of the present disclosure is to provide an axial flow impeller, which aims to reduce the turbulence generated at the blade, and thereby reduce the turbulence noise generated by the blade.

In order to achieve the above objective, the present disclosure provides an axial flow impeller including a hub and a plurality of blades provided at the hub, where: a blade edge of the blade includes a blade root edge, a front blade edge, a blade top edge and a rear blade edge connected sequentially, at a same circumference of the blade, a circumferential span from the front blade edge to the rear blade edge is $D_0$, a circumferential span from a divider strip connecting the blade root edge and the blade top edge to the front blade edge is $D_1$, $D_1/D_0$ is equal to or greater than 0.2 and equal to or smaller than 0.4, i.e., $D_1/D_0 \in [0.2, 0.4]$ and at the this circumference, a thickness of the blade at the divider strip is greater than thicknesses of the blade at other positions, and a thickness of the rear blade edge is smaller than a thickness of the front blade edge.

In some embodiments, the divider strip is configured to divide the blade into a front blade portion and a rear blade portion, at the same circumference of the blade, a thickness of the front blade portion gradually decreases from the divider strip to the front blade edge, and a thickness of the rear blade portion gradually decreases from the divider strip to the rear blade edge.

In some embodiments, the thickness of the blade at the divider strip is $H_0$, the thickness of the front blade edge is $H_1$, the thickness of the rear blade edge is $H_2$, $\Delta H_1$ is equal to $H_0-H_1$, $\Delta H_2$ is equal to $H_0-H_2$, and at the same circumference of the blade, $\Delta H_1$ is equal to or greater than 0.3 mm and equal to or smaller than 1.5 mm, i.e., $H_0-H_1 \in [0.3\text{ mm}, 1.5\text{ mm}]$, $\Delta H_2$ is equal to or greater than 2.5 mm and equal to or smaller than 5 mm, $H_0-H_2 \in [2.5\text{ mm}, 5\text{ mm}]$.

In some embodiments, $H_0$ is equal to or greater than 4.5 mm and equal to or smaller than 7.6 mm, i.e., $H_0 \in [4.5\text{ mm}, 7.6\text{ mm}]$, $H_1$ is equal to or greater than 3.0 mm and equal to or smaller than 7.3 mm, i.e., $H_1 \in [3.0\text{ mm}, 7.3\text{ mm}]$, and $H_2$ is equal to or greater than 1.7 mm and equal to or smaller than 2.5 mm, i.e., $H_2 \in [1.7\text{ mm}, 2.5\text{ mm}]$.

In some embodiments, at a same radial direction of the blade, the thickness of the blade gradually decreases from the blade root edge to the blade top edge.

In some embodiments, at the same circumference of the blade, an angle formed by a blade chord line connecting the front blade edge and the rear blade edge and a rotation plane of the axial flow impeller is $\alpha$, and $\alpha$ gradually decreases in a radial direction of the blade.

In some embodiments, $\alpha$ is equal to or greater than 20° and equal to or smaller than 30°, i.e., $\alpha \in [20°, 30°]$.

In some embodiments, $\alpha$ is equal to or greater than 20° and equal to or smaller than 28°, i.e., $\alpha \in [20°, 28°]$.

In some embodiments, a radius corresponding to a circumference at which the blade top edge lies is denoted as $R_0$, a radius corresponding to a circumference at which a blade chord line lies is denoted as $R_m$, and a radius coefficient of the circumference of the blade chord line is denoted as k, k is equal to $R_m/R_0$, and $R_m$ is equal to or greater than 0 and equal to or smaller than $R_0$, i.e., $R_m \in [0, R_0]$. Then when k is equal to or greater than 0 and equal to or smaller than 0.1, i.e., when $k \in [0, 0.1]$, $\alpha = 28° - k \times 30°$; when k is greater than 0.1 and equal to or smaller than 0.4, i.e., when $k \in (0.1, 0.4]$, $\alpha = 26° - k \times 10°$; and when k is greater than 0.4 and equal to or smaller than 1, i.e., when $k \in (0.4, 1]$, $\alpha = 23.3° - k \times 3.3°$.

In the technical solutions of the present disclosure, a divider strip connecting the blade root edge and the blade top edge is provided at the blade. The ratio $D_1/D_0$ of the circumferential span from the divider strip to the front blade edge to the circumferential span from the front blade edge to the rear blade edge is equal to or greater than 0.2 and equal to or smaller than 0.4. At the circumference, the thickness of the blade at the divider strip is greater than the thicknesses of the blade at other positions, and the thickness of the rear blade edge is smaller than the thickness of the front blade edge, such that the position of the maximum thickness of the blade appears at the divider strip, and the blade surface of the blade is raised at the position where the divider strip is located relative to other positions.

When the axial flow impeller operates, the front blade edge grabs the air flow forwards, the airflow blows through the blade surface of the blade through the front blade edge and flows backwards, and the airflow first flows to the divider strip. Affected by the slope of the bulge of the divider strip, the airflow has a tendency to flow "closer" to the blade surface of the blade at the rear side of the divider strip. After the airflow flows past the divider strip, the airflow continues to move backwards along the blade surface of the blade at the rear side of the divider strip. Therefore, the airflow is effectively moved backwards at the separation point of the blade surface of the blade, thereby reducing the generation of turbulent flow and reducing the turbulent noise. It can be seen that, compared with the conventional axial flow impeller, the axial flow impeller of the present disclosure can effectively move the airflow backwards at the separation point of the blade surface of the blade, thereby reducing the turbulence generated at the blade and reducing the turbulent noise generated by the blade.

Further, since the thickness of the rear blade edge is smaller than the thickness of the front blade edge, on the one hand, the front blade edge has better strength and can bear the impact of the airflow with a larger wind speed; on the other hand, the rear blade edge can have a better trail, which can effectively improve the trail flow at the rear side of the blade and reduce the trail noise.

BRIEF DESCRIPTION OF THE DRAWINGS

In order to more clearly illustrate the embodiments of the present disclosure, the drawings used in the embodiments will be briefly described below. Obviously, the drawings in the following description are only some embodiments of the present disclosure. It will be apparent to those skilled in the art that other figures can be obtained from the structures illustrated in the drawings without inventive effort.

DESCRIPTION OF REFERENCE NUMERALS

| Label | Name |
|---|---|
| 100 | air conditioner outdoor unit |
| 110 | housing |
| 120 | front panel |
| 130 | air outlet screen |

-continued

| Label | Name |
|---|---|
| 200 | hub |
| 300 | blade |
| 310 | front blade portion |
| 320 | rear blade portion |
| 330 | divider strip |
| 30a | blade root edge |
| 30b | front blade edge |
| 30c | blade top edge |
| 30d | rear blade edge |
| 10 | blade chord line |
| 20 | rotation plane |

The realization of the objective, functional characteristics, advantages of the present disclosure are further described with reference to the accompanying drawings.

DETAILED DESCRIPTION OF THE EMBODIMENTS

The technical solutions of the embodiments of the present disclosure will be clearly described in the following with reference to the accompanying drawings. It is obvious that the described embodiments are only some rather than all of the embodiments of the present disclosure. All other embodiments obtained by persons skilled in the art based on the embodiments of the present disclosure without creative efforts shall fall within the scope of the present disclosure.

It should be noted that, if there is directional indication (such as up, down, left, right, front, rear . . . ) in the embodiments of the present disclosure, the directional indication is only used to explain the relative positional relationship and movement between the components in a certain attitude (as shown in the Figures). If the specific attitude changes, the directional indication changes accordingly.

In addition, the descriptions, such as "first," "second" in the embodiments of the present disclosure, are merely for descriptive purposes, and should not be understood as indicating or suggesting relative importance or impliedly indicating the number of the indicated technical feature. Therefore, the feature associated with the "first," the "second" can expressly or impliedly include at least one such feature. Besides, the technical solutions of various embodiments can be combined with each other as long as they do not conflict with each other.

The present disclosure provides an axial flow impeller and air conditioner. The air conditioner may be a window air conditioner, a split air conditioner or a cabinet air conditioner. If the air conditioner is a window air conditioner, the axial flow impeller is provided at the outdoor side of the window air conditioner; if the air conditioner is a split air conditioner, the axial flow impeller is provided at the outdoor unit of the split air conditioner. In other embodiments, the axial flow impeller may also be provided in a fan of the air conditioner.

Figure 1:
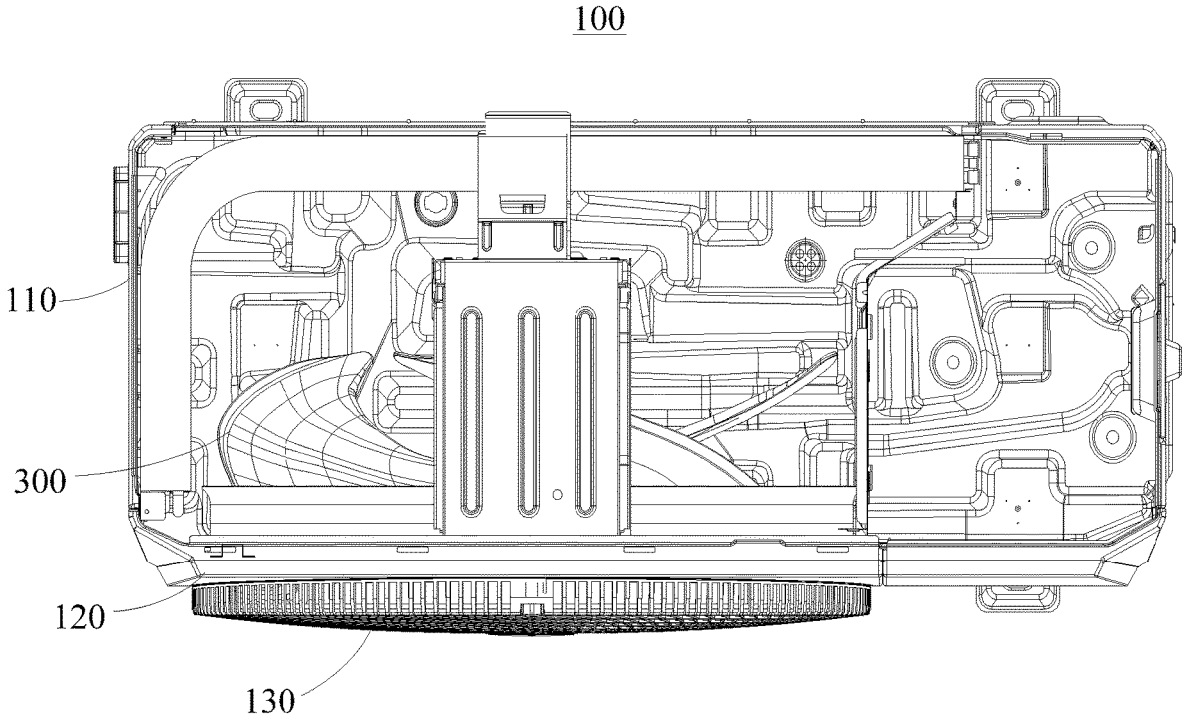
FIG. 1 is a schematic structural diagram of an air conditioner outdoor unit according to an embodiment of the present disclosure.

Referring to FIG. 1, in the following embodiments of the present disclosure, the air conditioner is a split air conditioner including an air conditioner outdoor unit 100. The air conditioner outdoor unit 100 includes a housing 110 and a front panel 120 mounted at the housing 110. The front panel 120 is provided with an air outlet, an air outlet screen 130 is mounted at the air outlet, and the axial flow impeller is arranged at the housing 110. The outlet side of the axial flow impeller is opposite to the air outlet. The axial flow impeller is arranged at the air conditioner outdoor unit. The axial flow impeller rotates and sends air to the outdoor, thereby discharging heat to the outdoor. The axial flow impeller may reduce the turbulence generated at the blade 300, thereby reducing the turbulence noise generated by the blade 300. In this embodiment, the axial flow impeller is arranged at the air conditioner.

Figure 2:
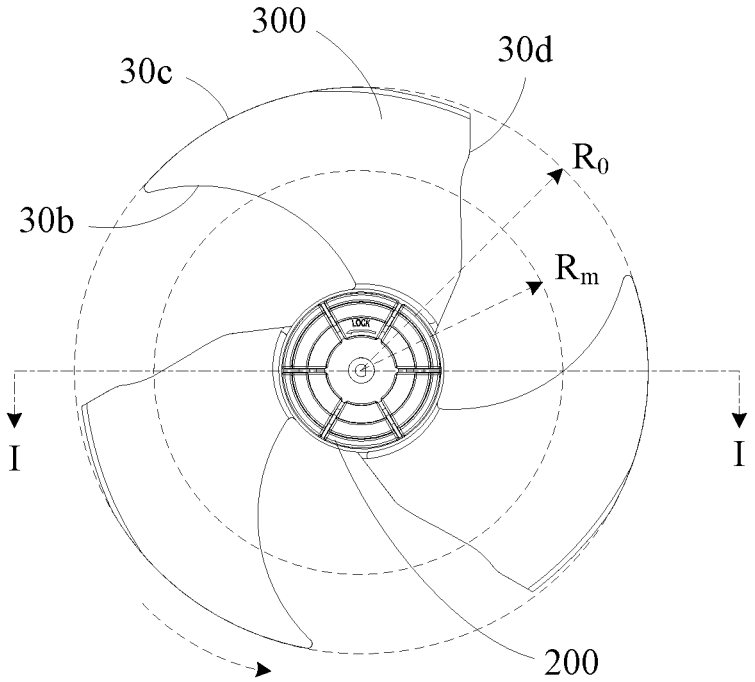
FIG. 2 is a schematic structural diagram of an axial flow impeller according to an embodiment of the present disclosure.
Figure 3:
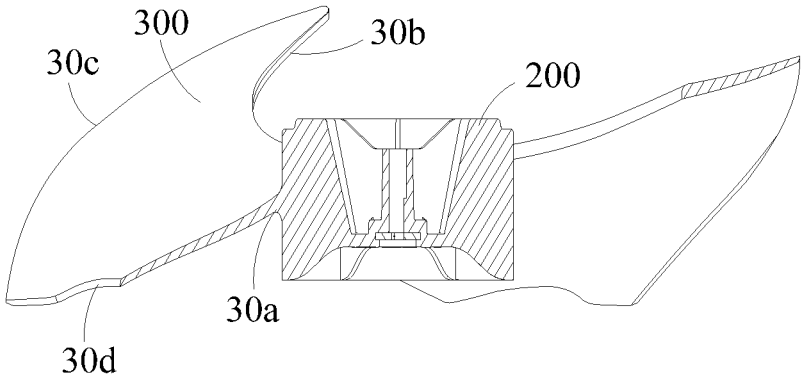
FIG. 3 is a cross-sectional view taken along line I-I in FIG. 2.
Figure 4:
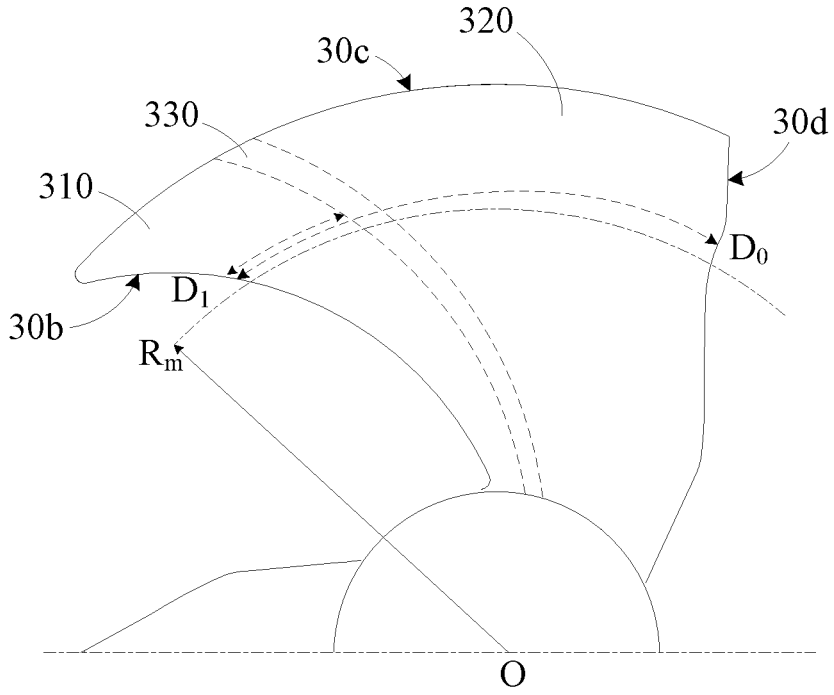
FIG. 4 is a schematic partial structural diagram of the axial flow impeller in FIG. 2.

Referring to FIG. 2 to FIG. 4, in an embodiment of the present disclosure, the axial flow impeller includes a hub 200 and a plurality of blades 300 provided at the hub 200. A blade edge of the blade 300 includes a blade root edge 30*a*, a front blade edge 30*b*, a blade top edge 30*c* and a rear blade edge 30*d* connected sequentially (the blade rotates from rear to front, as shown by the dashed arrow in FIG. 2). At a circumference of the blade 300, a circumferential span from the front blade edge 30*b* to the rear blade edge 30*d* is $D_0$, and a circumferential span from a divider strip 330, which connects the blade root edge 30*a* and blade top edge 30*c*, to the front blade edge 30*b* is $D_1$. $D_1/D_0$ is equal to or greater than 0.2 and equal to or smaller than 0.4. At the same circumference, a thickness of the blade 300 at the divider strip 330 is greater than thicknesses of the blade 300 at other positions, and a thickness of the rear blade edge 30*d* is smaller than a thickness of the front blade edge 30*b*.

Specifically, the plurality of blades 300 are evenly spaced around the outer circumference of the hub 200. The hub 200 is configured to connect with the driving motor, and driven by the driving motor to rotate the blade 300, to guide the airflow inside the air conditioner to the outdoor and exhaust the air to the outdoor. The number of the blades 300 is not specifically limited, and may be 3 to 5, in this embodiment, the number of the blades 300 is 3.

Referring to FIG. 4, in this embodiment, at the same circumference of the blade 300, the ratio of the circumferential span (i.e., $D_1$) from the divider strip 330 to the front blade edge 30*b* to the circumferential span (i.e., $D_0$) from the front blade edge 30*b* to the rear blade edge 30*d* is $D_1/D_0$. $D_1/D_0$ is equal to or greater than 0.2 and equal to or smaller than 0.4. That is, the divider strip 330 is located at the position $0.2D_0$ to $0.4D_0$ on the blade 300 closer to the front blade edge 30*b*. At the circumference, the thickness of the blade 300 at the divider strip 330 is greater than the thicknesses of the blade 300 at other positions, and the thickness of the rear blade edge 30*d* is smaller than the thickness of the front blade edge 30*b*. That is, the position of the maximum thickness of the blade 300 appears at the divider strip 330, and the thicknesses of the blade 300 at other positions are smaller than the thickness of the blade 300 at the divider strip 330. That is, the blade surface of the blade 300 is raised relative to other positions at the position where the divider strip 330 is located. It should be noted that the bulge should smoothly transition to the blade surface of the blade 300 on both sides, so that the slope of the bulge is relatively gentle. It should be noted here that in this embodiment and the following embodiments, the numerical sizes (except the thickness) of a technical feature refers to the size of the corresponding feature in the projection of the axial flow impeller on the horizontal plane when the axial flow impeller is placed horizontally.

Figure 7A:
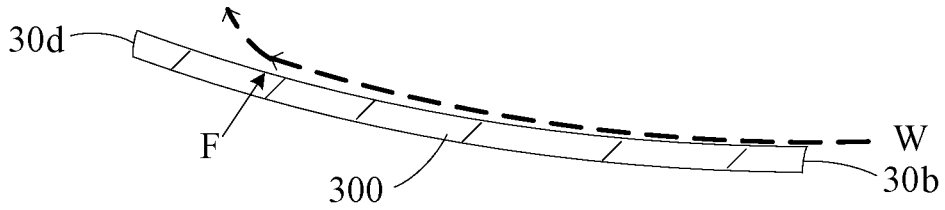
FIG. 7A is a schematic view of airflow flowing on the blade surface of a blade of a conventional axial flow impeller.
Figure 7B:
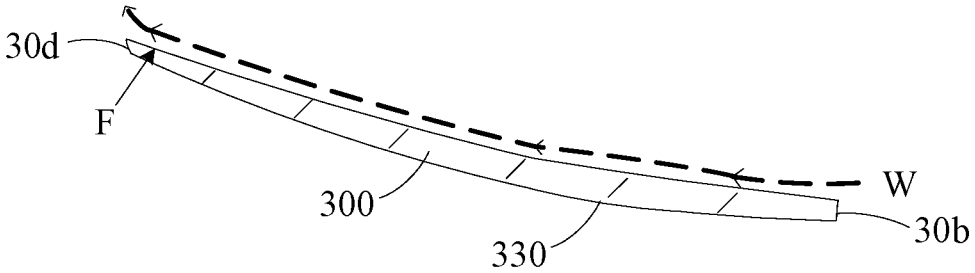
FIG. 7B is a schematic view of the airflow flowing on the blade surface of the blade of the axial flow impeller of the present disclosure.

As shown in FIG. 7B (W indicates the direction of airflow in FIG. 7B), when the axial flow impeller operates, the blade 300 rotates, the front blade edge 30*b* grabs the air flow forwards, the airflow blows through the blade surface of the blade 300 through the front blade edge 30*b* and flows backwards, and the airflow first flows to the divider strip 330. Affected by the slope of the bulge of the divider strip 330, the airflow has a tendency to flow "closer" to the blade surface of the blade 300 at the rear side of the divider strip 330. After the airflow flows past the divider strip 330, the airflow continues to move backwards along the blade surface of the blade 300 at the rear side of the divider strip 330. Therefore, the separation point of the airflow at the blade surface of the blade 300 is effectively moved backwards, thereby reducing the generation of turbulent flow and reducing the turbulent noise.

However, as shown in FIG. 7A (W indicates the direction of airflow in FIG. 7A), in the conventional axial flow impeller, the thickness of the blade 300 at the same circumference is uniform. The airflow directly moves backwards from the front blade edge 30*b* of the conventional blade 300 along the blade surface of the blade 300. The airflow is separated from the blade surface of the blade 300 before it reaches the rear blade edge 30*d*. The separated airflow forms a turbulent flow on the blade surface of the blade 300, thereby generating a large turbulence noise.

It should be noted here, the divider strip 330 is actually a part of the blade 300 itself, and $D_1$ should actually be the circumferential span from the radial bisector, i.e., a bisection line along the radial direction, of the divider strip 330 to the front blade edge 30*b*. The specific value of $D_1/D_0$ may be 0.2, 0.25, 0.3, or 0.35. A value of $D_1/D_0$ less than 0.2 may not provide obvious effect of the divider strip 330 moving the airflow separation point backward, and the noise reduction effect is not good. On the other hand, a value of $D_1/D_0$ greater than 0.4 may cause the divider strip 330 to affect the stability of the airflow flowing on the blade surface of the blade 300, and it is not easy to form a stable airflow. Therefore, in some embodiments, $D_1/D_0$ is maintained in the range of 0.2 to 0.4.

In order to verify the technical effect achieved by the axial flow impeller of the present disclosure, the axial flow impeller of the present disclosure and the conventional axial flow impeller were tested with the same number of blades 300 and under the same working conditions, and the measured data is as follows:

TABLE 1

Measured parameters for conventional axial flow impeller

| Rotation speed (r/min) | Air volume ($m^3/h$) | Power (w) | Noise (dB) |
|---|---|---|---|
| 850 | 3944 | 151.8 | 58.5 |
| 800 | 3723 | 132.1 | 56.2 |
| 750 | 3502 | 122.4 | 54.9 |
| 700 | 3244 | 112.7 | 52.1 |
| 650 | 2957 | 101.5 | 49.5 |

TABLE 2

Measured parameters for axial flow impeller of the present disclosure

| Rotation speed (r/min) | Air volume ($m^3/h$) | Power (w) | Noise (dB) |
|---|---|---|---|
| 850 | 3977 | 151.9 | 56.4 |
| 800 | 3746 | 132.1 | 54.1 |
| 750 | 3539 | 122.3 | 52.9 |
| 700 | 3261 | 112.8 | 50.2 |
| 650 | 2974 | 101.4 | 47.3 |

Figure 11:
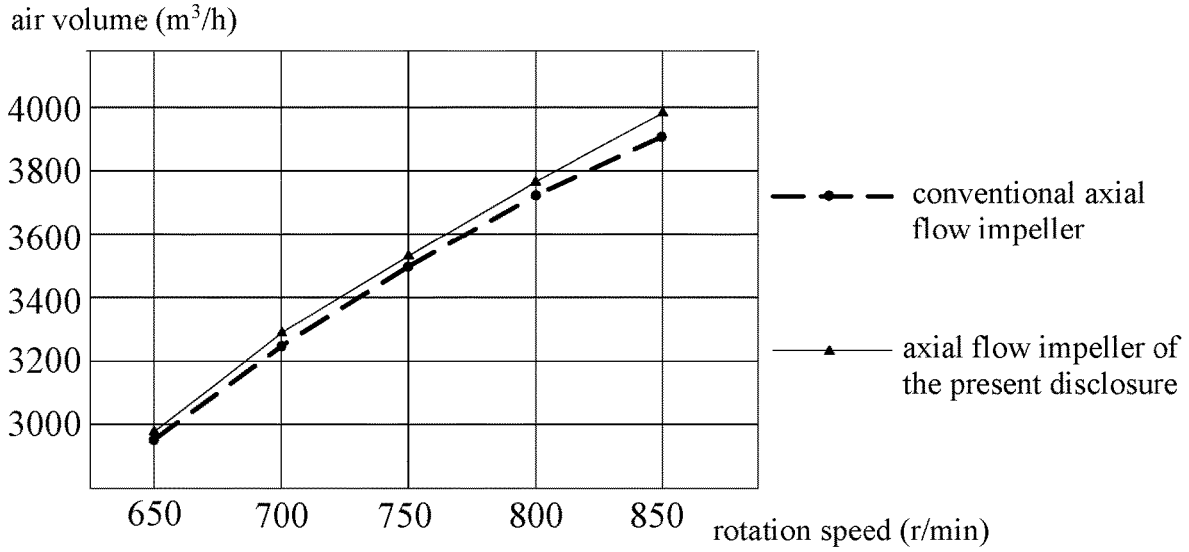
FIG. 11 is a diagram showing the comparison of rotation speed-air volume test results between the axial flow impeller of the present disclosure and the conventional axial flow impeller.
Figure 12:
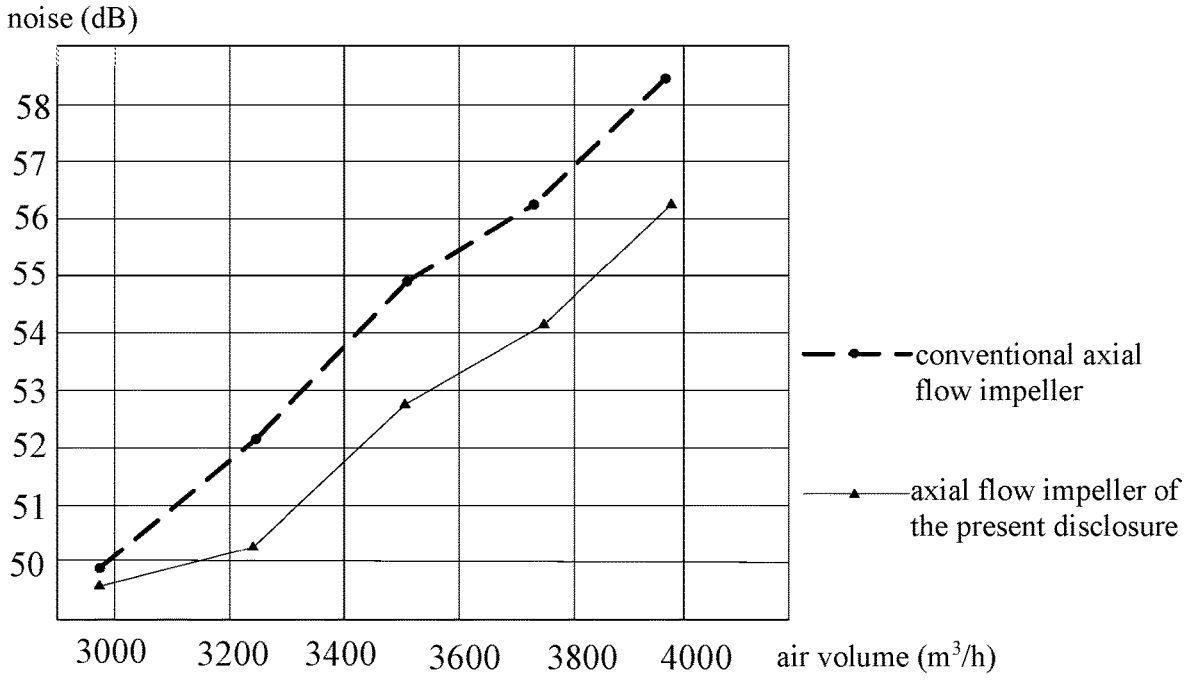
FIG. 12 is a diagram showing the comparison of air volume-noise test results between the axial flow impeller of the present disclosure and the conventional axial flow impeller.

Based on the measured data shown in Tables 1 and 2 above, a speed-air volume test comparison diagram (as shown in FIG. 11) and an air volume-noise test comparison diagram (as shown in FIG. 12) are drawn. It can be seen that, under the same rotation speed condition, compared with the conventional axial flow impeller, although the air flow and power of the axial flow impeller of the present disclosure are basically the same as the conventional axial flow impeller, the noise of the axial flow impeller of the present disclosure is significantly reduced, and the reduction is close to 2 dB, which greatly improves the noise problem of the axial flow impeller.

In the technical solutions of the present disclosure, a divider strip 330 connecting the blade root edge 30*a* and the blade top edge 30*c* is provided at the blade 300. The ratio $D_1/D_0$ of the circumferential span from the divider strip 330 to the front blade edge 30*b* to the circumferential span from the front blade edge 30*b* to the rear blade edge 30*d* is equal to or greater than 0.2 and equal to or smaller than 0.4. At the circumference, the thickness of the blade 300 at the divider strip 330 is greater than the thicknesses of the blade 300 at other positions, and the thickness of the rear blade edge 30*d* is smaller than the thickness of the front blade edge 30*b*. That is, the position of the maximum thickness of the blade 300 is at the divider strip 330. That is, the blade surface of the blade 300 is raised relative to other positions at the position where the divider strip 330 is located.

When the axial flow impeller operates, the blade 300 rotates, the front blade edge 30*b* grabs the air flow forwards, the airflow blows through the blade surface of the blade 300 through the front blade edge 30*b* and flows backwards 9, and the airflow first flows to the divider strip 330. Affected by the slope of the bulge of the divider strip 330, the airflow has a tendency to flow "closer" to the blade surface of the blade 300 at the rear side of the divider strip 330. After the airflow flows past the divider strip 330, the airflow continues to move backwards along the blade surface of the blade 300 at the rear side of the divider strip 330. Therefore, the airflow is effectively moved backwards at the separation point of the blade surface of the blade 300, thereby reducing the generation of turbulent flow and reducing the turbulent noise. It can be seen that, compared with the conventional axial flow impeller, the axial flow impeller of the present disclosure can effectively move the airflow backwards at the separation point of the blade surface of the blade 300, thereby reducing the turbulence generated at the blade 300, and reducing the turbulent noise generated by the blade 300.

Further, since the thickness of the rear blade edge 30*d* is smaller than the thickness of the front blade edge 30*b*, on the one hand, the front blade edge 30*b* has better strength and can bear the impact of the airflow with a larger wind speed; on the other hand, the rear blade edge 30*d* can have a better trail, which can effectively improve the trail flow at the rear side of the blade 300 and reduce the trail noise.

Figure 5:
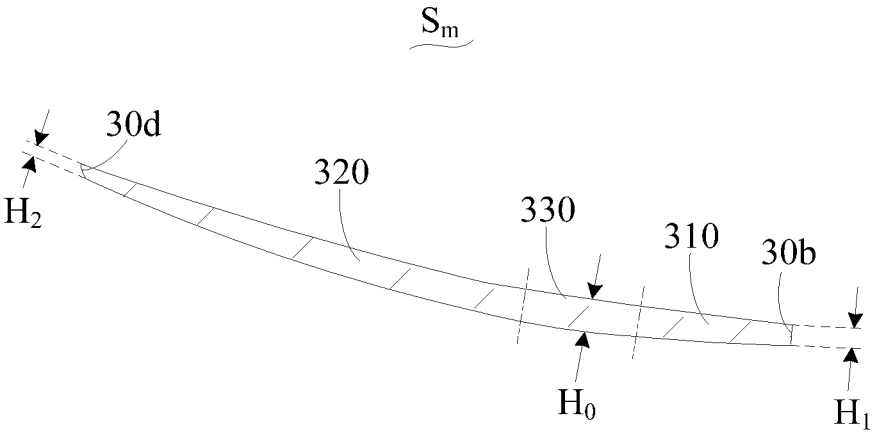
FIG. 5 is a schematic view of the cross section of the blade taken along the circumference of the blade in FIG. 4 with a radius of $R_m$.

Referring to FIG. 4 and FIG. 5, based on the above embodiments, in order to improve the stability of the airflow on the blade surface of the blade 300 and reduce the generation of turbulent noise, the divider strip 330 is configured to divide the blade 300 into a front blade portion 310 and a rear blade portion 320. At the same circumference of the blade 300, a thickness of the front blade portion 310 gradually decreases from the divider strip 330 to the front blade edge 30*b*, and a thickness of the rear blade portion 320 gradually decreases from the divider strip 330 to the rear blade edge 30*d*.

Specifically, a concave arc is used to smoothly transition and connect the front side of the divider strip 330 to the front blade portion 310. The thickness of the front blade portion 310 gradually decreases from the divider strip 330 to the front blade edge 30*b*, so that an inclined surface inclined towards the front blade edge 30*b* is formed in the front blade portion 310. The concave arc is used to smoothly transition and connect the rear side of the divider strip 330 to the rear blade portion 320. The thickness of the rear blade portion 320 gradually decreases from the divider strip 330 to the rear blade edge 30*d*, so that an inclined surface inclined towards the rear blade edge 30*d* is formed in the rear blade portion 320.

When the airflow flows on the blade surface of the blade 300, the airflow first flows from the front blade edge 30*b* along the inclined surface of the front blade portion 310 to the divider strip 330, and after passing the divider strip 330, the airflow tends to flow towards the surface of the rear blade portion 320 and gradually moves along the inclined surface of the rear blade portion 320 towards the rear blade edge 30*d*, which greatly facilitates the backward movement of the airflow at the separation point of the blade surface of the blade 300.

Figure 8:
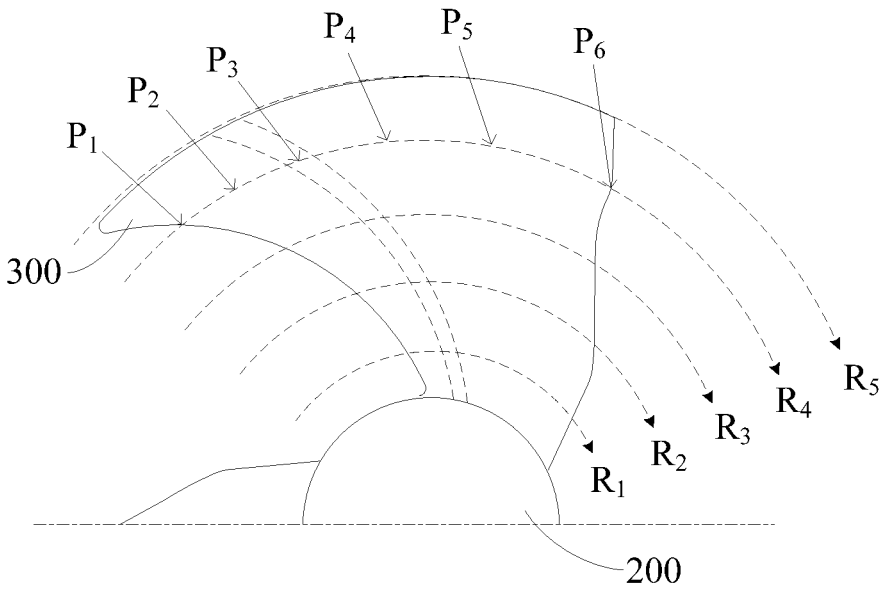
FIG. 8 is another schematic partial structural diagram of the axial flow impeller in FIG. 2.
Figure 9:
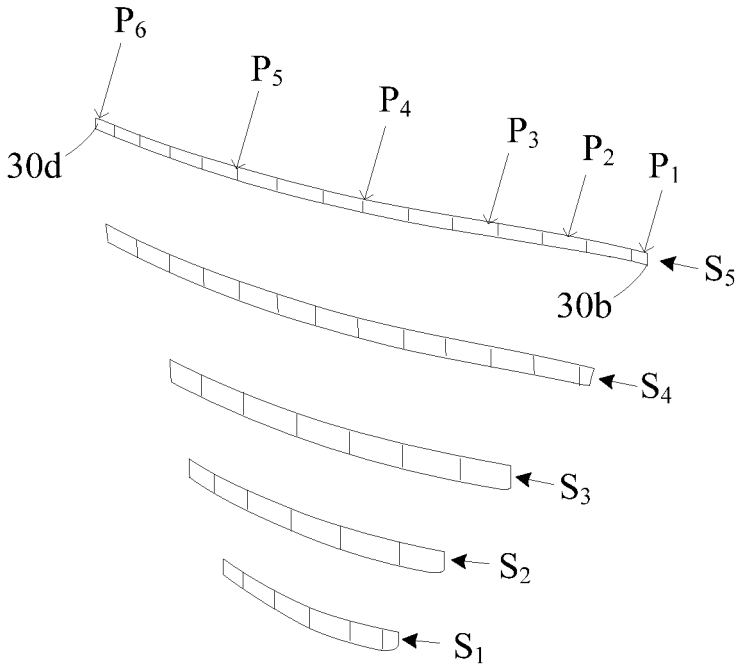
FIG. 9 is a schematic diagram showing the comparison among the cross sections of the blade in FIG. 8 taken along circumferences with different radii of $R_m$.

Referring to FIG. 4, FIG. 8 and FIG. 9, $S_m$ denotes the circumferential section taken on the blade 300 according to a circumference with the hub 200 as the center and $R_m$ as the radius. This circumferential section $S_m$ is a virtual section for explanation. Therefore, the circumferential section of the blade 300 is taken on the blade 300 according to the circumference where $R_1$, $R_2$, $R_3$, $R_4$, $R_5$ are located to obtain the circumferential section $S_1$, the circumferential section $S_2$, the circumferential section $S_3$, the circumferential section $S_4$ and the circumferential section $S_5$ in sequence. $R_1$ to $R_5$ increase sequentially. Along the same radial direction of the blade 300, a total of m sampling points from $P_1$ to $P_m$ are taken at each circumferential section $S_m$, and the thicknesses of the sampling points $P_1$ to $P_m$ corresponding to each circumferential section $S_m$ are recorded. In this embodiment, taking m=6 as an example, $P_1$ and $P_2$ are located at the front blade portion 310, and $P_1$ belongs to the front blade edge 30*b*; $P_3$ is located at the divider strip 330; $P_4$ to $P_6$ are located at the rear blade portion 320, and $P_6$ belongs the rear blade edge 30*d*. The thickness data of the sampling points $P_1$ to $P_6$ of each circumferential section $S_m$ is recorded as shown in Table 3 below:

TABLE 3

Thicknesses at different positions of various circumferential sections

| | $P_m$ | | | | | |
|---|---|---|---|---|---|---|
| | front blade portion | | divider strip | | rear blade portion | |
| $S_m$ | $P_1$ | $P_2$ | $P_3$ | $P_4$ | $P_5$ | $P_6$ |
| | thickness/mm | | | | | |
| $S_1$ | 7.14 | 7.32 | 7.60 | 6.71 | 4.47 | 2.79 |
| $S_2$ | 6.37 | 6.53 | 6.71 | 5.22 | 3.71 | 2.57 |
| $S_3$ | 5.15 | 5.43 | 5.76 | 4.62 | 3.10 | 2.46 |
| $S_4$ | 2.96 | 4.11 | 5.04 | 4.31 | 3.68 | 2.28 |
| $S_5$ | 2.71 | 3.93 | 4.81 | 4.05 | 3.16 | 2.14 |

As can be seen from the above table, at any circumference of the blade 300 (i.e., a single circumferential section), the maximum thickness position of the blade 300 is located at the divider strip 330, and at the circumference, the thickness of the front blade portion 310 gradually decreases from the divider strip 330 to the front blade edge 30*b*, and the thickness of the rear blade portion 320 gradually decreases from the divider strip 330 to the rear blade edge 30*d*.

Referring to FIG. 4 and FIG. 5, the thickness of the blade 300 at the divider strip 330, the thickness of the front blade edge 30*b* and the thickness of the rear blade edge 30*d* should not be too large, otherwise, the thickness difference at various positions on the blade surface of the blade 300 will be too large, which is not conducive to the stable flow of airflow. Suppose the thickness of the blade 300 at the divider strip 330 is $H_0$, the thickness of the front blade edge 30*b* is $H_1$, and the thickness of the rear blade edge 30*d* is $H_2$. In some embodiments, at the same circumference of the blade 300, $H_0-H_1$ is equal to or greater than 0.3 mm and equal to or smaller than 1.5 mm, and $H_0-H_2$ is equal to or greater than 2.5 mm and equal to or smaller than 5 mm.

Hereinafter, $\Delta H_1$ equal to $H_0-H_1$ and $\Delta H_2$ equal to $H_0-H_2$ are used for description. Thus, in some embodiments, $\Delta H_1$ is equal to or greater than 0.3 mm and equal to or smaller than 1.5 mm, and $\Delta H_2$ is equal to or greater than 2.5 mm and equal to or smaller than 5 mm. At the same radial position of the blade 300, $\Delta H_1$ may be a fixed constant value, for example, 0.3 mm, 0.5 mm or 1 mm. In some embodiments, $\Delta H_1$ gradually increases with the increase of a circumferential radius, i.e., a radius of a circumference, of the blade 300, for example, from 0.3 mm to 1 mm or 1.5 mm. Likewise, at the same radial position of the blade 300, $\Delta H_2$ may be a fixed constant value, for example, 3 mm, 3.5 mm or 4 mm. In some embodiments, $\Delta H_2$ gradually decreases with the increase of the circumferential radius of the blade 300, for example, from 5 mm to 2 mm or 2.5 mm.

Based on the data in Table 3 above as an example, the comparison data of $\Delta H_1$ and $\Delta H_2$ corresponding to the circumferential sections can be obtained as shown in Table 4 below:

TABLE 4

Comparison of $\Delta H_1$ and $\Delta H_2$ corresponding to various circumferential sections

| | $S_m$ | | | | |
|---|---|---|---|---|---|
| $\Delta H$ | $S_1$ | $S_2$ | $S_3$ thickness/mm | $S_4$ | $S_5$ |
| $\Delta H_1$ | 0.3 | 0.34 | 0.61 | 2.08 | 2.10 |
| $\Delta H_2$ | 4.81 | 4.41 | 3.30 | 2.86 | 2.67 |

According to the data in Table 4 above, at the same radial position of the blade 300, as the circumferential radius of the circumferential section $S_m$ on the blade increases, $\Delta H_1$ gradually increases, and $\Delta H_2$ gradually decreases.

In order to confirm the effect of the thickness variation of the front blade portion 310 and the rear blade portion 320 of the blade 300 on the axial flow impeller, based on the test experiment of the above embodiments, the axial flow impeller is further tested at the same speed, and the experimental results are as follows:

TABLE 5

Measured parameters for axial flow impeller of the present disclosure

| Rotation speed (r/min) | Air volume ($m^3$/h) | Power (w) | Noise (dB) |
|---|---|---|---|
| 850 | 3973 | 152.0 | 56.1 |
| 800 | 3736 | 132.1 | 53.7 |
| 750 | 3531 | 122.1 | 52.5 |
| 700 | 3257 | 112.7 | 49.7 |
| 650 | 2968 | 101.4 | 47.2 |

Based on the analysis of the data in Table 1, Table 2 and Table 5 above it can be seen that at the same rotation speed, the noise of the axial flow impeller in this embodiment is reduced by nearly 2.4 dB compared to the conventional axial flow impeller, and the noise reduction effect is better. That is, at the same radial direction of the blade 300, as the circumferential radius of the circumferential section $S_m$ on the blade increases, $\Delta H_1$ gradually increases, while $\Delta H_2$ gradually decreases, which causes the axial flow impeller to achieve a better noise reduction effect.

In this embodiment, at the same radial direction of the blade 300, the thickness of the blade 300 gradually decreases from the blade root edge 30*a* to the blade top edge 30*c*. As such, the thickness of the portion of the blade 300 adjacent to the blade root edge 30*a* is relatively large, so as to ensure the stability of the connection between the blade 300 and the hub 200, while the thickness of the portion of the blade 300 adjacent to the blade root edge 30*a* is relatively small, and the flow guiding capability is better, which is beneficial to reduce air loss.

Referring to FIG. 5, it should be noted here that the thickness of the blade 300 at the divider strip 330, the thickness of the front blade edge 30*b* and the thickness of the rear blade edge 30*d* should not be too large, otherwise, the thickness of the blade 300 itself will be increased, so that the wind resistance of the blade 300 is greater and the power consumption is greater. Besides, these three should also not be too small, otherwise the thickness of the blade 300 itself is too small, which leads to the weak strength of the blade 300, and it is easy to deform during high-speed rotation. Therefore, in some embodiments, $H_0$ is equal to or greater than 4.5 mm and equal to or smaller than 7.6 mm, $H_1$ is equal to or greater than 3.0 mm and equal to or smaller than 7.3 mm, and $H_2$ is equal to or greater than 1.7 mm and equal to or smaller than 2.5 mm.

Specifically, in the direction from the blade top edge 30*c* to the blade root edge 30*a* of the blade 300, the thickness $H_0$ of the divider strip 330 may gradually increase from 4.5 mm to 7 mm or 7.6 mm, or from 5 mm to 7.6 mm, the thickness $H_1$ of the front blade edge 30*b* may gradually increase from 3.0 mm to 6 mm or 7 mm, or from 4 mm to 7 mm, and the thickness $H_2$ of the rear blade edge 30*d* may gradually increase from 1.7 mm to 2 mm or 2.5 mm, or from 2 mm to 2.5 mm.

Figure 6:
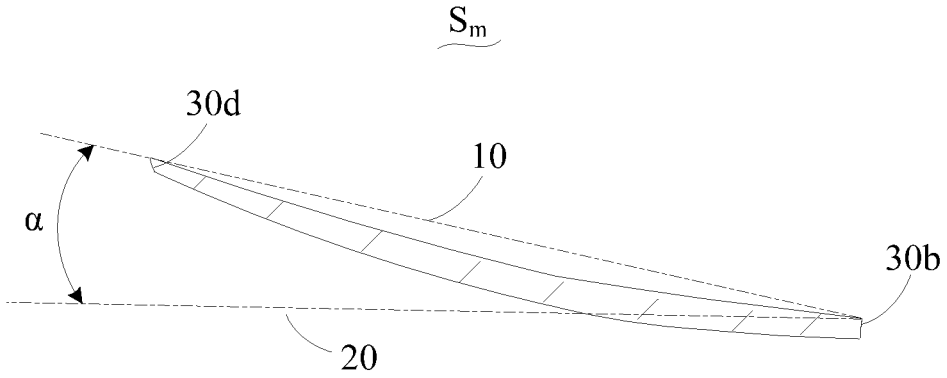
FIG. 6 is a schematic view of the cross section of the blade taken along the circumference of the blade in FIG. 4 with a radius of another $R_m$.

Referring to FIG. 4 and FIG. 6, based on the above embodiments, in order to increase the air volume and pressure of the axial flow impeller, improve work efficiency and reduce noise, in this embodiment, at the same circumference of the blade 300, an angle formed by a blade chord line 10, which connects the front blade edge 30*b* and the rear blade edge 30*d*, and a rotation plane 20 of the axial flow impeller is $\alpha$, and $\alpha$ gradually decreases in a radial direction of the blade 300. It should be noted that the blade chord line 10 is a virtual line segment for explaining the shape and structure of the blade 300. The angle $\alpha$ is also referred to as a "chord line tilt angle."

The angle $\alpha$ formed by the blade chord line 10 and the rotation plane 20 of the axial flow impeller should not be too large or too small, otherwise it is difficult to achieve the effect of reducing noise. In order to verify the influence of the angle formed by the blade chord line 10 and the rotation plane 20 of the axial flow impeller in the radial direction of the fan blade 300 on the noise reduction effect, the following tests were conducted at the same speed: $R_1$ to $R_7$ are all circumferential radii centered on the hub 200, and $R_1$ to $R_7$ increase sequentially. Tests were performed at each circumference of the blade 300 for different sizes of a to obtain the test data of the noise values corresponding to ($\alpha$, R) as shown in Table 6 below.

TABLE 6

| Measured parameters for axial flow impeller of the present disclosure | | | | | | | |
|---|---|---|---|---|---|---|---|
| | R | | | | | | |
| α | $R_1$ | $R_2$ | $R_3$ | $R_4$ noise/dB | $R_5$ | $R_6$ | $R_7$ |
| 16° | 54.5 | 54.1 | 54.6 | 54.8 | 55.3 | 55.1 | 55.4 |
| 18° | 53.9 | 53.2 | 53.1 | 53.5 | 54.8 | 55.0 | 55.2 |
| 20° | 51.5 | 52.5 | 52.6 | 53.1 | 53.6 | 53.8 | 54.4 |
| 22° | 52.4 | 51.2 | 52.3 | 52.8 | 53.2 | 53.5 | 53.8 |
| 24° | 53.1 | 52.9 | 50.5 | 52.3 | 52.7 | 52.9 | 53.1 |
| 26° | 53.6 | 53.1 | 52.8 | 50.1 | 52.3 | 52.6 | 52.9 |
| 28° | 54.1 | 53.5 | 53.1 | 52.8 | 50.8 | 52.1 | 52.5 |
| 30° | 54.3 | 54.1 | 53.6 | 53.1 | 52.5 | 51.7 | 52.3 |
| 32° | 54.5 | 54.3 | 53.9 | 53.5 | 52.8 | 52.6 | 52.1 |

As can be seen from Table 6 above:

At (20°, $R_1$), the noise value is 51.5 dB;

At (22°, $R_2$), the noise value is 51.2 dB;

At (24°, $R_3$), the noise value is 50.5 dB;

At (26°, $R_4$), the noise value is 50.1 dB;

At (28°, $R_5$), the noise value is 50.8 dB;

At (30°, $R_6$), the noise value is 51.7 dB.

That is, as the circumferential radius of the blade surface of the blade 300 increases in the radial direction of the blade 300, α increases from 18° to 20°, the noise of the axial flow impeller is basically above 52 dB, even reaching 55.4 dB. When α gradually increases from 20° to 30° in this direction, the noise of the axial flow impeller is kept at a relatively low level, basically less than 52 dB; in this direction, when α is gradually increased from 30°, the noise of the axial flow impeller is increased to more than 52 dB. As can be seen, at the same circumference of the blade 300, when the α gradually increases from 20° to 30° in the radial direction of the blade 300, the noise reduction effect of the axial flow impeller is better. Therefore, preferably, α is equal to or greater than 20° and equal to or smaller than 30°.

Thus, as the circumferential radius of the blade surface of the blade 300 increases in the radial direction of the blade 300, when α gradually increases from 20° to 28°, the noise reduction effect of the axial flow impeller is the best, all are less than 51.5 dB. And at this time, the bending angle of the entire blade surface of the blade 300 is not too large, and the air volume and air pressure of the axial flow impeller are increased, which can not only reduce the noise, but also obtain a larger air volume. Therefore, in some embodiments, α is chosen to be equal to or greater than 20° and equal to or smaller than 28°.

Referring to FIG. 8 and FIG. 9, in order to ensure the stability of the connection between the blade 300 and the hub 200 and improve the air supply capacity of the blade 300, the angle α formed by the blade chord line 10 of the blade 300 and the rotation plane 20 of the axial flow impeller may decrease rapidly near the hub 200 and decrease slowly at positions far away from the hub 200.

In this embodiment, a radius corresponding to a circumference at which the blade top edge lies is denoted as $R_0$, a radius corresponding to a circumference at which a blade chord line lies is denoted as $R_m$, and a radius coefficient of the circumference of the blade chord line is denoted as k, where k is equal to $R_m/R_0$ and $R_m$ is equal to or greater than 0 and equal to or smaller than $R_0$.

When k is equal to or greater than 0 and equal to or smaller than 0.1, $\alpha=28°-k\times30°$.

When k is greater than 0.1 and equal to or smaller than 0.4, $\alpha=26°-k\times10°$.

When k is greater than 0.4 and equal to or smaller than 1, $\alpha=23.3°-k\times3.3°$.

Figure 10:
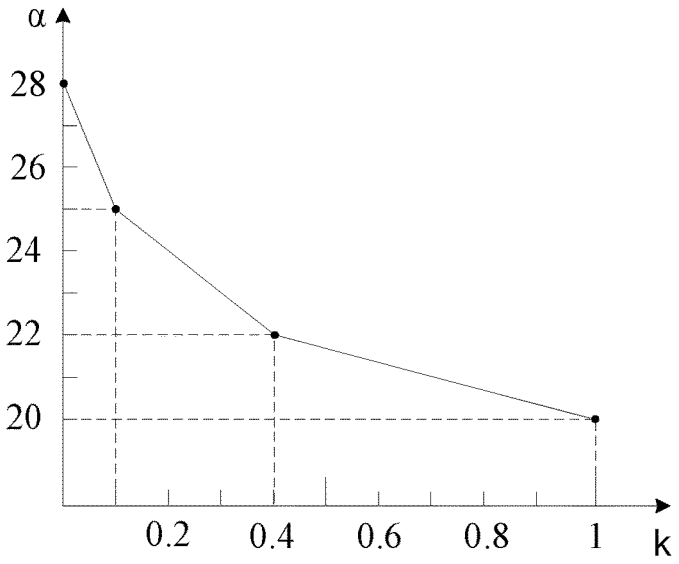
FIG. 10 is a schematic diagram showing the change of the angle formed by the chord line of the blade of the axial flow impeller and the rotation plane of the axial flow impeller in the radial direction according to the present disclosure.

Referring to FIG. 9 and FIG. 10, $R_m$ is equal to or greater than 0 and equal to or smaller than $R_0$, and k is equal to $R_m/R_0$, thus k is equal to or greater than 0 and equal to or smaller than 1, i.e., $k\in[0, 1]$. As the radius $R_m$ of the circumference at which the blade chord line 10 lies increases, the radius coefficient k gradually increases. When k is equal to or greater than 0 and equal to or smaller than 0.1, $\alpha=28°-k\times30°$, i.e., as the radius coefficient k increases from 0 to 0.1, α rapidly decreases from 28° to 25°. When k is greater than 0.1 and equal to or smaller than 0.4, $\alpha=26°-k\times10°$, i.e., as the radius coefficient k increases from 0.1 to 0.4, a gradually decreases from 25° to 22°. When k is greater than 0.4 and equal to or smaller than 1, $\alpha=23.3°-k\times3.3$, i.e., as the radius coefficient k increases from 0.4 to 1, α slowly decreases from 22° to 20°.

As can be seen, α decreases rapidly near the hub 200, so that the blade root position of the blade 300 and the hub 200 form a large mounting angle. As such, not only can the stability of the connection between the blade 300 and the hub 200 be enhanced, but also the air supply capability of the blade 300 can be improved. On the other hand, α gradually decreases at positions away from the hub 200, and the blade surface of the blade 300 is gentler, which can reduce the formation of the blade top vortex and thereby reduce noise.

The above are only some embodiments of the present disclosure, and thus do not limit the scope of the present disclosure. Under the inventive concept of the present disclosure, equivalent structural transformations made according to the description and drawings of the present disclosure, or direct/indirect application in other related technical fields are included in the scope of the present disclosure.

What is claimed is:

1. An axial flow impeller comprising:

a hub; and a blade provided at the hub, wherein:

a blade edge of the blade includes a blade root edge, a front blade edge, a blade top edge, and a rear blade edge connected sequentially;

the blade includes a divider strip arranged between the front blade edge and the rear blade edge and connecting the blade root edge and the blade top edge;

at a same circumference of the blade:

a ratio between a circumferential span from the divider to the front blade edge and a circumferential span from the front blade edge to the rear blade edge is equal to or greater than 0.2 and equal to or smaller than 0.4, a thickness of the divider strip is greater than thicknesses of other portions of the blade, and a thickness of the rear blade edge is smaller than a thickness of the front blade edge, and a difference $\Delta H_1$ between the thickness of the divider strip $H_0$ and the thickness of the front blade edge $H_1$ is equal to or greater than 0.3 mm and equal to or smaller than 1.5 mm, and a difference $\Delta H_2$ between $H_0$ and the thickness of the rear blade edge $H_2$ is equal to or greater than 2.5 mm and equal to or smaller than 5 mm; and at a same radial direction of the blade, $\Delta H_1$ is fixed and has a constant value, or $\Delta H_1$ gradually increases as a circumferential radius of the blade increases.

2. The axial flow impeller of claim 1, wherein:

the divider strip is configured to divide the blade into a front blade portion and a rear blade portion; and at the same circumference of the blade, a thickness of the front blade portion gradually decreases from the divider strip to the front blade edge, and a thickness of the rear blade portion gradually decreases from the divider strip to the rear blade edge.

3. The axial flow impeller of claim 1, wherein:

at the same radial direction of the blade $\Delta H_2$ is a fixed and has a constant value; or as the circumferential radius of the blade increases, $\Delta H_2$ gradually decreases.

4. The axial flow impeller of claim 1 wherein at the same radial direction of the blade, as a circumferential radius of a circumferential section of the blade increases, $\Delta H_1$ gradually increases and $\Delta H_2$ gradually decreases.

5. The axial flow impeller of claim 1, wherein $H_0$ is equal to or greater than 4.5 mm and equal to or smaller than 7.6 mm, $H_1$ is equal to or greater than 3.0 mm and equal to or smaller than 7.3 mm, and $H_2$ is equal to or greater than 1.7 mm and equal to or smaller than 2.5 mm.

6. The axial flow impeller of claim 1, wherein at the same radial direction of the blade, the thickness of the blade gradually decreases from the blade root edge to the blade top edge.

7. The axial flow impeller of claim 1, wherein an angle $\alpha$ formed by a blade chord line, which connects the front blade edge and the rear blade edge at the same circumference of the blade, and a rotation plane of the axial flow impeller gradually decreases in a radial direction of the blade.

8. The axial flow impeller of claim 7, wherein $\alpha$ is equal to or greater than 20° and equal to or smaller than 30°.

9. The axial flow impeller of claim 8, wherein $\alpha$ is equal to or greater than 20° and equal to or smaller than 28°.

10. The axial flow impeller of claim 9, wherein $\alpha$ and a radius coefficient k, which is a ratio between a circumferential radius of the blade chord line and a circumferential radius of the blade top edge, satisfy following relations:

when k is equal to or greater than 0 and equal to or smaller than 0.1, $\alpha=28°-k\times30°$;

when k is greater than 0.1 and equal to or smaller than 0.4, $\alpha=26°-k\times10°$; and when k is greater than 0.4 and equal to or smaller than 1, $\alpha=23.3°-k\times3.3°$.

11. An air conditioner comprising:

an axial flow impeller including:

a hub; and a blade provided at the hub, wherein:

a blade edge of the blade includes a blade root edge, a front blade edge, a blade top edge, and a rear blade edge connected sequentially;

the blade includes a divider strip arranged between the front blade edge and the rear blade edge and connecting the blade root edge and the blade top edge;

at a same circumference of the blade:

a ratio between a circumferential span from the divider to the front blade edge and a circumferential span from the front blade edge to the rear blade edge is equal to or greater than 0.2 and equal to or smaller than 0.4, a thickness of the divider strip is greater than thicknesses of other portions of the blade, and a thickness of the rear blade edge is smaller than a thickness of the front blade edge, and a difference $\Delta H_1$ between the thickness of the divider strip $H_0$ and the thickness of the front blade edge $H_1$ is equal to or greater than 0.3 mm and equal to or smaller than 1.5 mm, and a difference $\Delta H_2$ between $H_0$ and the thickness of the rear blade edge $H_2$ is equal to or greater than 2.5 mm and equal to or smaller than 5 mm; and at a same radial direction of the blade, $\Delta H_1$ is fixed and has a constant value, or $\Delta H_1$ gradually increases as a circumferential radius of the blade increases.

12. The air conditioner of claim 11, wherein the divider strip is configured to divide the blade into a front blade portion and a rear blade portion; and at the same circumference of the blade, a thickness of the front blade portion gradually decreases from the divider strip to the front blade edge, and a thickness of the rear blade portion gradually decreases from the divider strip to the rear blade edge.

13. The air conditioner of claim 11, wherein at the same radial direction of the blade, as the circumferential radius of a circumferential section of the blade increases, $\Delta H_1$ gradually increases and $\Delta H_2$ gradually decreases.

14. The air conditioner of claim 11, wherein $H_0$ is equal to or greater than 4.5 mm and equal to or smaller than 7.6 mm, $H_1$ is equal to or greater than 3.0 mm and equal to or smaller than 7.3 mm, and $H_2$ is equal to or greater than 1.7 mm and equal to or smaller than 2.5 mm.

15. The air conditioner of claim 11, wherein an angle $\alpha$ formed by a blade chord line, which connects the front blade edge and the rear blade edge at the same circumference of the blade, and a rotation plane of the axial flow impeller gradually decreases in a radial direction of the blade.

16. The air conditioner of claim 15, wherein $\alpha$ is equal to or greater than 20° and equal to or smaller than 30°.

17. The air conditioner of claim 16, wherein $\alpha$ and a radius coefficient k, which is a ratio between a circumferential radius of the blade chord line and a circumferential radius of the blade top edge, satisfy following relations:

when k is equal to or greater than 0 and equal to or smaller than 0.1, $\alpha=28°-k\times30°$;

when k is greater than 0.1 and equal to or smaller than 0.4, $\alpha=26°-k\times10°$; and when k is greater than 0.4 and equal to or smaller than 1, $\alpha=23.3°-k\times3.3°$.

18. An axial flow impeller comprising:

a hub; and a blade provided at the hub, wherein:

a blade edge of the blade includes a blade root edge, a front blade edge, a blade top edge, and a rear blade edge connected sequentially;

the blade includes a divider strip arranged between the front blade edge and the rear blade edge and connecting the blade root edge and the blade top edge;

at a same circumference of the blade:

a ratio between a circumferential span from the divider to the front blade edge and a circumferential span from the front blade edge to the rear blade edge is equal to or greater than 0.2 and equal to or smaller than 0.4, and a thickness of the divider strip is greater than thicknesses of other portions of the blade, and a thickness of the rear blade edge is smaller than a thickness of the front blade edge; and at a same radial direction of the blade, the thickness of the blade gradually decreases from the blade root edge to the blade top edge.

* * * * *